US011993931B1

(12) United States Patent
Mol

(10) Patent No.: US 11,993,931 B1
(45) Date of Patent: May 28, 2024

(54) BUILDING SYSTEM WITH MODULAR INTERLOCKING PANELS

(71) Applicant: Gary R. Mol, Marblehead, OH (US)

(72) Inventor: Gary R. Mol, Marblehead, OH (US)

(73) Assignee: RAMPART TECHNOLOGIES, INC., Naples, FL (US)

( * ) Notice: Subject to any disclaimer, the term of this patent is extended or adjusted under 35 U.S.C. 154(b) by 0 days.

(21) Appl. No.: 18/402,077

(22) Filed: Jan. 2, 2024

(51) Int. Cl.
*E04C 2/34* (2006.01)
*E04C 2/00* (2006.01)
*E04C 2/16* (2006.01)

(52) U.S. Cl.
CPC ..... *E04C 2/34* (2013.01); *E04C 2002/004* (2013.01); *E04C 2/16* (2013.01); *E04C 2002/3488* (2013.01)

(58) Field of Classification Search
None
See application file for complete search history.

(56) References Cited

U.S. PATENT DOCUMENTS 3,823,525 A * 7/1974 Bruun ..... F16B 5/0044 52/468
4,744,192 A * 5/1988 Commins ..... F16B 9/052 403/232.1
5,152,114 A * 10/1992 Beazley ..... E04B 7/063 52/285.3
5,272,850 A * 12/1993 Mysliwiec ..... E04B 1/6158 52/775
6,212,849 B1 * 4/2001 Pellock ..... E04B 1/26 52/762
6,314,704 B1 * 11/2001 Bryant ..... E04B 7/20 52/745.1
D452,016 S * 12/2001 Hall ..... D25/121
7,017,311 B2 * 3/2006 Weiss ..... E04B 2/7425 52/282.1
7,690,167 B2 * 4/2010 Antonic ..... E04C 3/29 52/489.1
7,694,483 B1 * 4/2010 Tucker ..... E04B 1/28 52/92.2
7,748,172 B2 * 7/2010 Zupancich ..... B32B 27/06 105/355

(Continued)

FOREIGN PATENT DOCUMENTS

GB 651542 A * 4/1951

*Primary Examiner* — Joshua K Ihezie
(74) *Attorney, Agent, or Firm* — Donald J. Ersler

(57) ABSTRACT

A building system with modular interlocking panels preferably includes at least one wall section, at least one header, at least one wall sill, a plurality of cripples, and a plurality of support strips. Each wall section preferably includes a bottom horizontal C-channel, a plurality of bottom C-channel flanges, a plurality of vertical C-channels, a top horizontal C-channel, a plurality of top C-channel flanges, an outer panel, an inner panel, a first angled end panel connector, and a second angled end panel connector or an end panel connector. The header, wall sill and cripples include the bottom horizontal C-channel, the C-channel flanges, the plurality of vertical C-channels, the top horizontal C-channel, the outer panel, the inner panel and end panel connectors. The plurality of support strips preferably include a plurality of outer support strips and a plurality of inner support strips.

20 Claims, 8 Drawing Sheets

(56) References Cited

U.S. PATENT DOCUMENTS

| | | | | |
|---|---|---|---|---|
| 7,900,411 | B2 * | 3/2011 | Antonic | E04H 9/14 52/293.3 |
| 7,992,352 | B2 * | 8/2011 | Bonds | E04B 1/08 52/712 |
| 8,601,763 | B2 * | 12/2013 | Bui | E04B 1/41 52/422 |
| 8,601,769 | B2 * | 12/2013 | Amar | B32B 3/266 52/796.1 |
| 8,769,887 | B2 * | 7/2014 | Proffitt, Jr. | E04B 2/58 52/696 |
| 9,493,938 | B2 * | 11/2016 | Schiffmann | E04C 2/46 |
| 9,938,719 | B2 * | 4/2018 | Derleth | E04B 5/48 |
| 11,299,886 | B2 * | 4/2022 | El-Domiaty | E04B 2/60 |
| 11,492,796 | B2 * | 11/2022 | Walker | F16B 35/065 |
| 11,566,426 | B2 * | 1/2023 | Boss | E04D 3/366 |
| 11,613,891 | B2 * | 3/2023 | Inglese | E04B 7/022 52/79.1 |
| 11,674,312 | B2 * | 6/2023 | Inglese | E04B 2/96 52/79.1 |
| 2002/0002804 | A1 * | 1/2002 | Sheehy | E04B 1/12 52/93.2 |
| 2002/0069600 | A1 * | 6/2002 | Bryant | E04B 7/20 52/794.1 |
| 2005/0076805 | A1 * | 4/2005 | Creighton | B61D 17/08 105/404 |
| 2006/0254167 | A1 * | 11/2006 | Antonic | E04B 1/28 52/293.3 |
| 2007/0094992 | A1 * | 5/2007 | Antonic | E04B 1/24 52/656.1 |
| 2018/0073248 | A1 * | 3/2018 | Derleth | E04B 1/541 |
| 2021/0115675 | A1 * | 4/2021 | Mol | E04C 2/46 |
| 2022/0064942 | A1 * | 3/2022 | Inglese | E04C 3/11 |

* cited by examiner

BUILDING SYSTEM WITH MODULAR INTERLOCKING PANELS

BACKGROUND OF THE INVENTION

1. Field of the Invention

The present invention relates generally to building construction and more specifically, a building system with modular interlocking panels, which decreases the complexity of a finished building.

2. Discussion of the Prior Art

Patent no. 11613891 to Inglese discloses fiber reinforced polymer building systems and methods.

Accordingly, there is a clearly felt need in the art for a building system with modular interlocking panels, which decreases the complexity of a building while providing a finished building with high wind resistance.

SUMMARY OF THE INVENTION

The present invention provides a building system with modular interlocking panels, which provides a finished building with high wind resistance. The building system with modular interlocking panels preferably includes at least one wall section, at least one header, at least one wall sill, a plurality of cripples, and a plurality of support strips. Each wall section preferably includes a bottom horizontal C-channel, a plurality of bottom C-channel flanges, a plurality of vertical C-channels, a top horizontal C-channel, a plurality of top C-channel flanges, an outer panel, an inner panel, a first angled end panel connector, and a second angled end panel connector or an end panel connector. The plurality of C-channel flanges are preferably attached to the bottom horizontal C-channel with the plurality of C-channel flanges, a plurality of fasteners and a bonding substance.

Each bottom C-channel flange includes a bottom member and an upright member, which extends upward from the bottom member. A web slot is preferably formed in the upright member to receive a web of a vertical C-channel. At least one fastener hole is preferably formed through the upright member to threadably receive at least one fastener. A bottom of the vertical C-channel is preferably retained in the upright member with at least one fastener and the bonding substance. At least two fastener holes are preferably formed through the bottom member to receive at least two fasteners for attachment to the bottom horizontal C-channel. Each vertical C-channel is preferably spaced 16 inches apart. Along a length of the bottom horizontal C-channel. The plurality of top C-channel flanges are preferably attached to a bottom of the top horizontal C-channel with the plurality of fasteners and bonding substance. A top of the vertical C-channel is preferably retained in the upright member of the top C-channel flange with at least one fastener and the bonding substance.

An inside surface of a bottom of the angled end panel connector or the end panel connector is attached to an outside surface of the bottom horizontal C-channel with the plurality of fasteners and the bonding substance. A top of the angled end panel connector or the end panel connector is preferably attached to an outside surface of the top horizontal C-channel with the plurality of fasteners and the bonding substance.

The angled end panel connector preferably includes a first wall leg, a first end leg, an angled end leg, a second end leg and a second wall leg. The first end leg extends outward from an end of the first wall leg. The angled end leg extends backward at an acute angle from an end of the first end leg. The second end leg extends outward from an end of angled end leg. The second wall leg extends backward from an end of the second end leg. The first wall leg and the second wall leg are parallel to each other. The first end leg and the second end leg are parallel to each other. The angled end leg has an angular relationship relative to the first and second wall legs, and the first and second end legs. The first and second wall legs are perpendicular to the first and second end legs. Adjacent wall sections are connected to each other using angled end panel connectors.

The end panel connector preferably includes a first wall leg, a first end leg, a middle wall leg, a second end leg and a second wall leg. The first end leg extends outward from an end of the first wall leg. The middle wall leg extends outward from an end of the first end leg. The second end leg extends outward from an end of the middle wall leg. The second wall leg extends backward from an end of the second end leg. The first wall leg, the middle wall leg and the second wall leg are parallel to each other. The first end leg and the second end leg are parallel to each other. The first end leg and the second end leg are perpendicular to the first wall leg, the middle wall leg and the second wall leg. Corners of adjacent walls of a building are connected to each other using the end panel connectors. The wall sections preferably come in 2 or 4 foot lengths and 8, 9 or 10 foot heights. However, other lengths and heights may also be used.

Each header or wall sill preferably includes a bottom horizontal C-channel, a plurality of bottom C-channel flanges, a plurality of vertical C-channels, a top horizontal C-channel, a plurality of top C-channel flanges, an outer panel, an inner panel, a first angled end panel connector or an end panel connector and a second angled end panel connector. The height of each header is less than a height of the wall section. The length of the header may be any suitable length. Assembly of the header components is the same as the wall section.

Each cripple preferably includes a bottom horizontal C-channel, at least one bottom cripple C-channel flange, at least one vertical C-channel, a top horizontal C-channel, at least one top cripple C-channel flange, an outer panel, an inner panel and, an angled end panel connector. The height of each cripple is less than a height of the wall section. The cripple may be any suitable length. Assembly of the cripple components is the same as the wall section.

The plurality of support strips preferably include a plurality of outer support strips and a plurality of inner support strips. Each support strip includes a floor flange and a channel flange which extends upward from an end of the floor flange. A plurality of floor holes are formed through the floor flange to receive a plurality floor fasteners for anchoring the floor flange to a floor slab. A plurality of channel holes are formed through the channel flange for anchoring to the bottom horizontal C-channel or the plurality of vertical C-channels with fasteners and a bonding substance. However, the inner and outer support strips may be replaced with a single floor C-channel with an inner width, which is sized to receive a thickness of the wall section, wall sill and cripples.

Accordingly, it is an object of the present invention to provide a building system with modular interlocking panels, which decreases the complexity of a finished building.

Finally, it is another object of the present invention to provide a building system with modular interlocking panels, which provides a finished building with high wind resistance.

These and additional objects, advantages, features and benefits of the present invention will become apparent from the following specification.

DETAILED DESCRIPTION OF THE PREFERRED EMBODIMENTS

Figure 1:
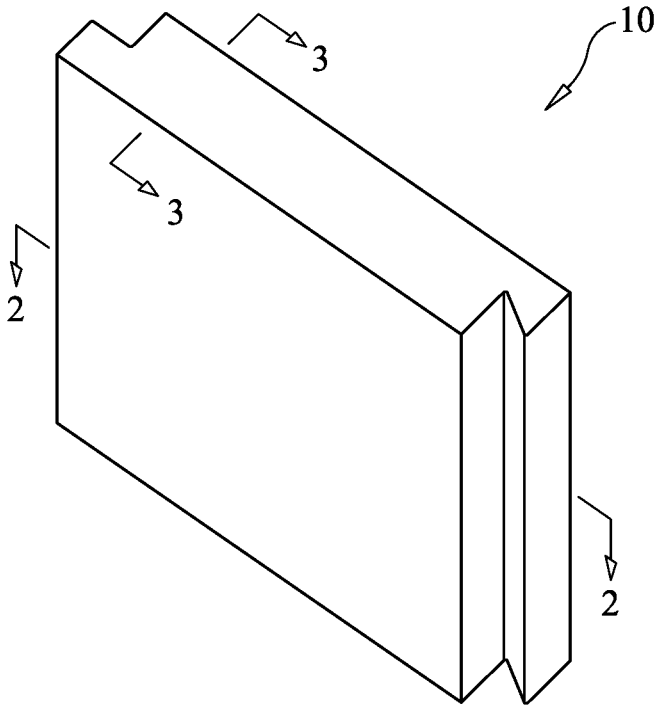
FIG. 1 is a perspective view of a wall section of a building system with modular interlocking panels in accordance with the present invention.
Figure 2:
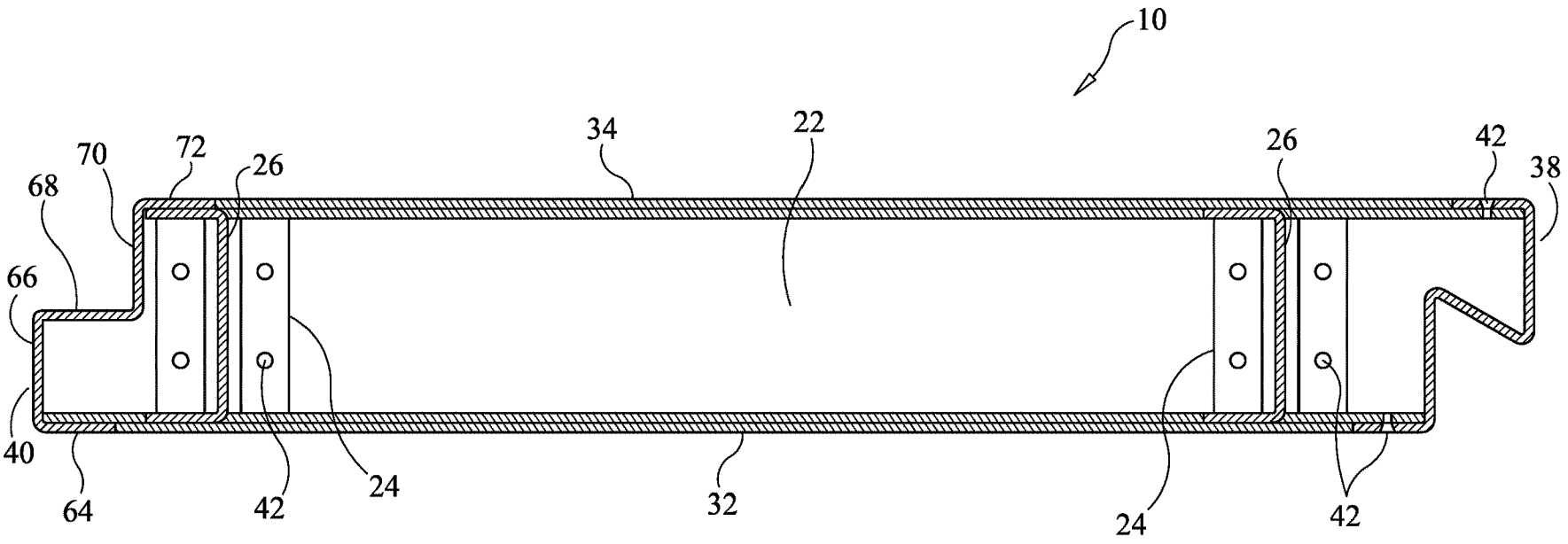
FIG. 2 is a cross section view of a wall section of a building system with modular interlocking panels cut through FIG. 1 in accordance with the present invention.
Figure 3:
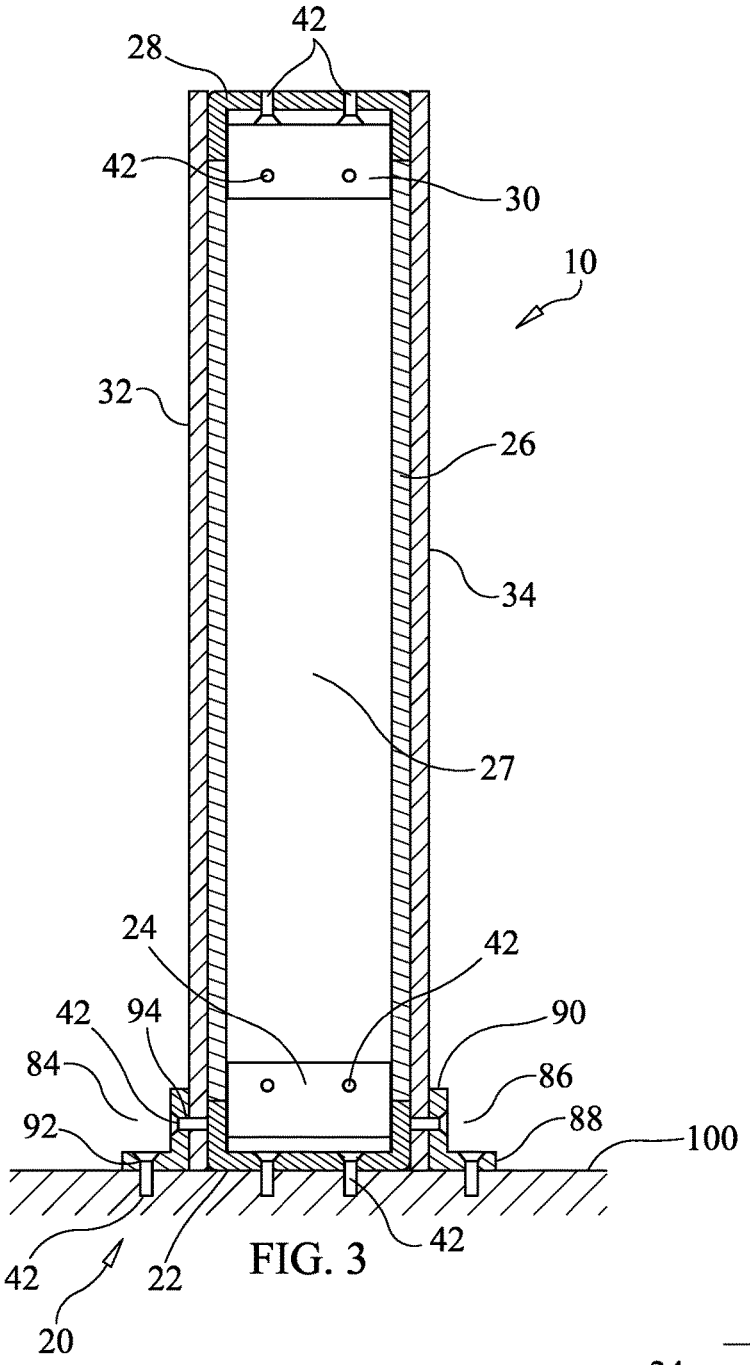
FIG. 3 is a cross section view of a wall section of a building system with modular interlocking panels cut through FIG. 1 in accordance with the present invention.
Figure 4:
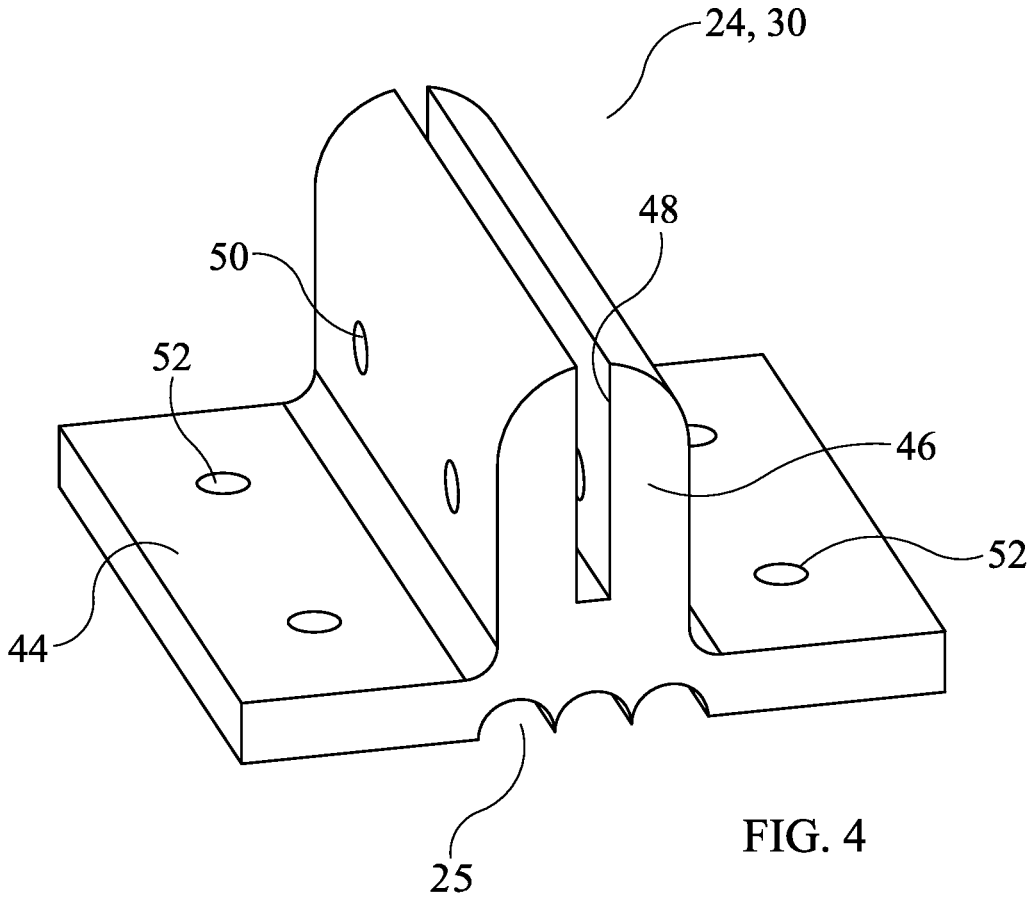
FIG. 4 is a perspective view of a bottom or top C-channel flange for retaining a vertical C-channel in a horizontal C-channel of a building system with modular interlocking panels in accordance with the present invention.
Figure 8:
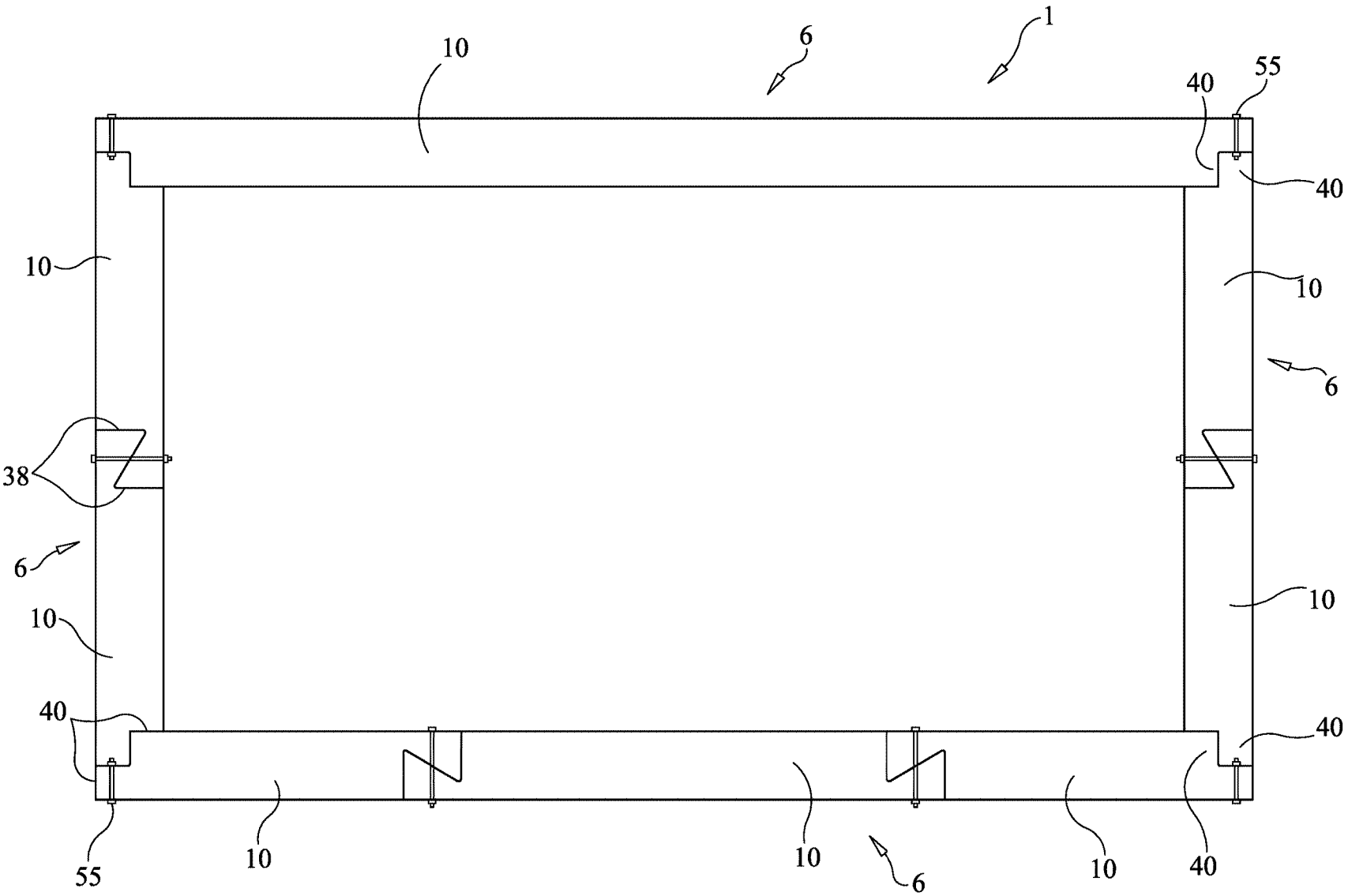
FIG. 8 is a top view of an assembled building system with modular interlocking panels in accordance with the present invention.

With reference now to the drawings, and particularly to FIG. 8, there is shown a top view of an assembled building system with modular interlocking panels 1. With reference to FIGS. 1-5, the building system with modular interlocking panels 1 preferably includes at least one wall section 10, at least one header 12, at least one wall sill 14, at least one door cripple 16, at least one window cripple 18 and a plurality of support strips 20. With reference to FIGS. 2, 3, and 4, each wall section 10 preferably includes a bottom horizontal C-channel 22, a plurality of bottom C-channel flanges 24, a plurality of vertical C-channels 26, a top horizontal C-channel 28, a plurality of top C-channel flanges 30, an outer panel 32, an inner panel 34, a first angled end panel connector 36, and a second angled end panel connector 38 or an end panel connector 40. The plurality of C-channel flanges 24 are retained in and preferably attached to the bottom horizontal C-channel with fasteners 42 and a bonding substance. The bonding substance is preferably a two-part epoxy which may be purchased with different cure times. However, other bonding substances may also be used. At least one bonding groove 25 is preferably formed in a bottom of the C-channel flange 24 to receive the bonding substance. The C-channels 22, 26, 28 and channel flanges 24 30 are preferably fabricated from a pultruded fiberglass, but other materials could also be used.

With reference to FIG. 4, each bottom C-channel flange 24 includes a bottom member 44 and an upright member 46, which extends upward from the bottom member 44. A web slot 48 is formed in the upright member 46 to receive a web 27 of a vertical C-channel 26. At least one fastener hole 50 is preferably formed through the upright member to threadably receive the at least one fastener 42. A bottom of the vertical C-channel is preferably retained in the web slot 48 with the at least one fastener 42 and the bonding substance. At least two fastener holes 52 are preferably formed through the bottom member to receive the at least two fasteners 42 for attachment to the bottom horizontal C-channel 22. At least one bonding cavity is preferably formed on a bottom of the bottom member 44 to receive a bonding substance. Each vertical C-channel 26 is preferably spaced 16 inches apart along a length of the bottom horizontal C-channel 22. The plurality of top C-channel flanges 30 are preferably attached to a bottom of the top horizontal C-channel 28 with the plurality of fasteners 42 and the bonding substance. A top of the vertical C-channel 26 is preferably retained in the web slot 48 of the upright member 46 of the top C-channel flange 30 with the at least one fastener 42 and the bonding substance.

With reference to FIG. 2, an inside surface of a bottom of the angled end panel 38 connector or the end panel connector 40 is attached to an outside surface of the bottom horizontal C-channel 22 with the plurality of fasteners 42 and the bonding substance. A top of the angled end panel connector 38 or the end panel connector 42 is preferably attached to an outside surface of the top horizontal C-channel 28 with the plurality of fasteners 42 and the bonding substance.

Figure 6:
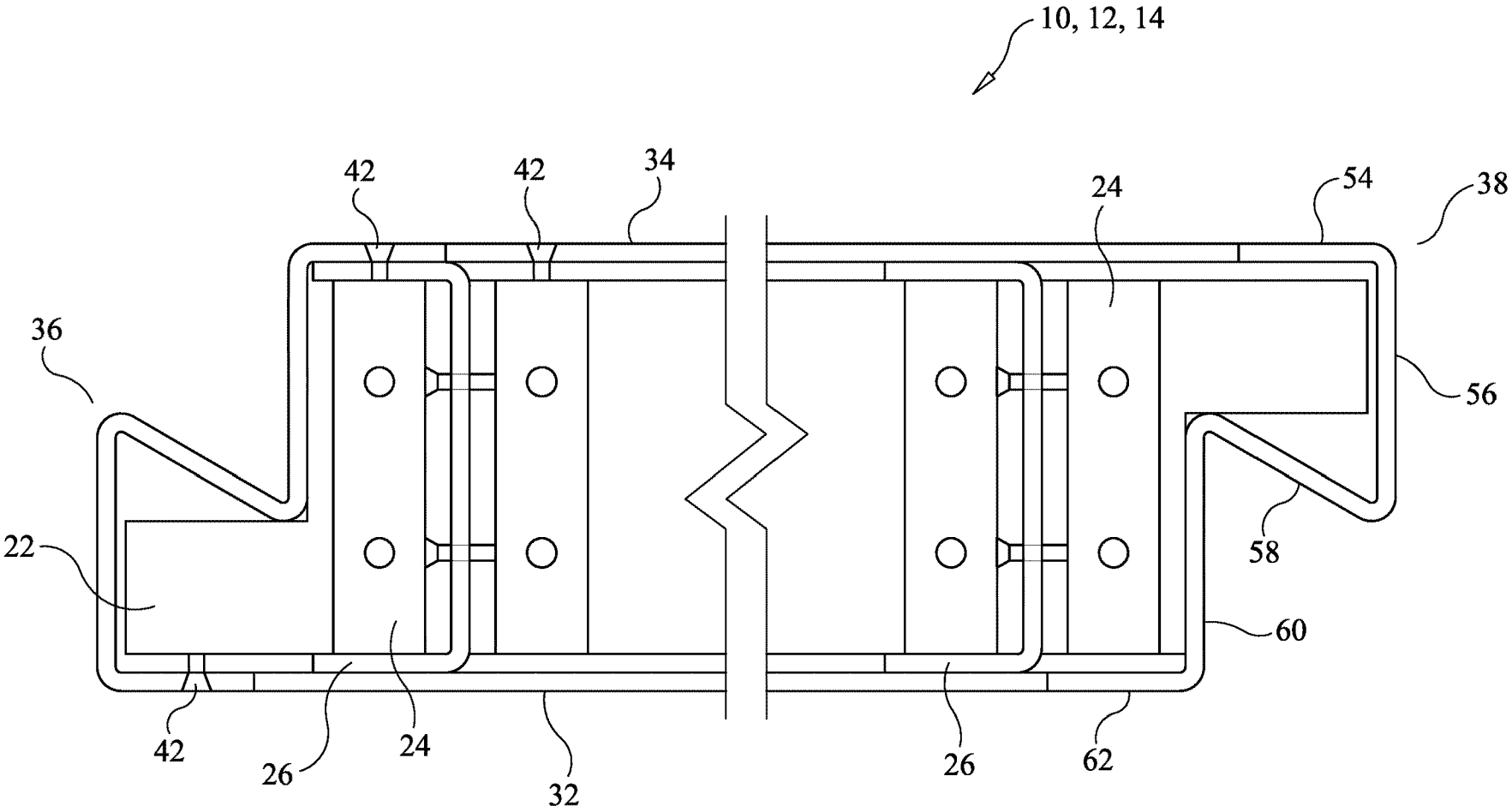
FIG. 6 is a top view of a wall section, a header or a wall sill with an upper horizontal C-channel removed of a building system with modular interlocking panels in accordance with the present invention.

With reference to FIG. 6, the angled end panel connector 36, 38 preferably includes a first wall leg 54, a first end leg 56, an angled end leg 58, a second end leg 60 and a second wall leg 62. The first end leg 56 extends outward from an end of the first wall leg 54. The angled end leg 58 extends backward at an acute angle from an end of the first end leg 56. The second end leg 60 extends outward from an end of the angled end leg 58. The second wall leg 62 extends backward from an end of the second end leg 60. The first wall leg 54 and the second wall leg 62 are parallel to each other. The first end leg 56 and the second end leg 60 are parallel to each other. The angled end leg 58 has an angular relationship relative to the first and second wall legs 54, 62, and the first and second end legs 56, 60. The first and second wall legs 54, 62 are perpendicular to the first and second end legs 56, 60. Adjacent wall sections 10 are connected to each other using angled end panel connectors 38 with a plurality of fasteners 55 and the bonding agent.

The end panel connector 40 preferably includes a first wall leg 64, a first end leg 66, a middle wall leg 68, a second end leg 70 and a second wall leg 72. The first end leg 66 extends outward from an end of the first wall leg 64. The middle wall leg 68 extends backward from an end of the first end leg 66. The second end leg 70 extends outward from an end of the middle wall leg 68. The second wall leg 72 extends backward from an end of the second end leg 70. The first wall leg 64, the middle wall leg 68 and the second wall leg 72 are parallel to each other. The first end leg 66 and the second end leg 70 are parallel to each other. The first end leg 66 and the second end leg 70 are perpendicular to the first wall leg 64, the middle wall leg 68 and the second wall leg 72.

Figure 5:
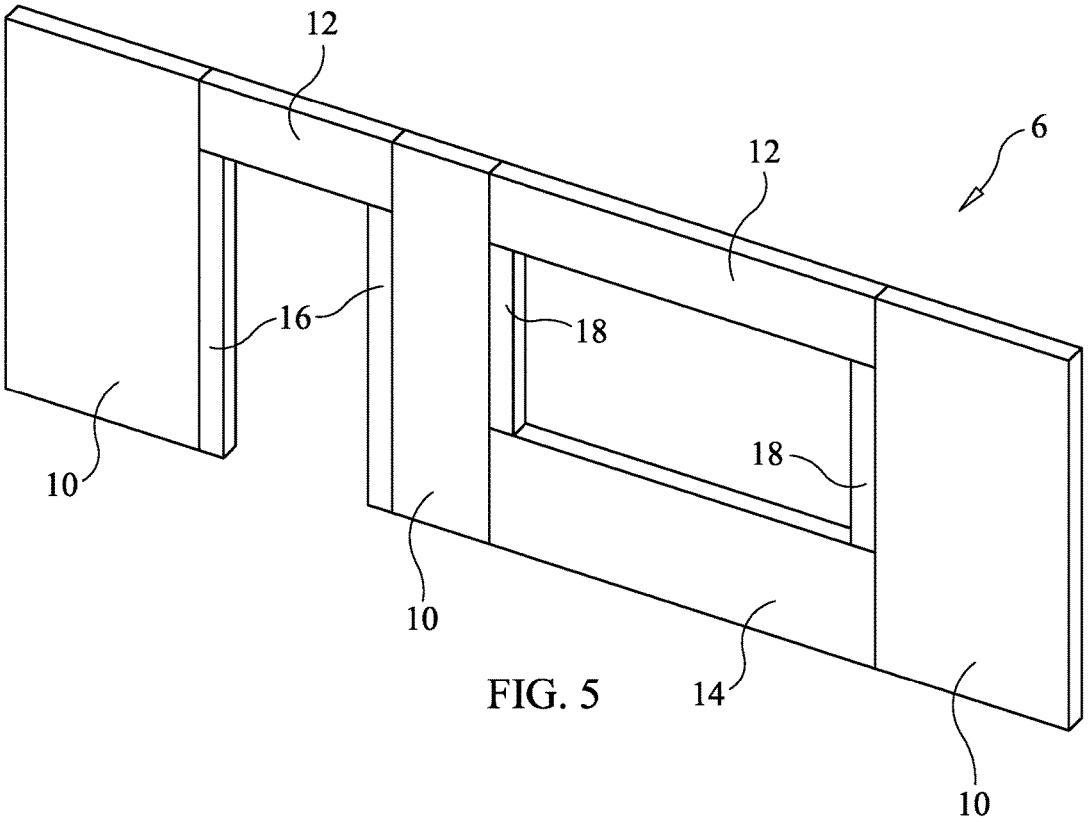
FIG. 5 is a perspective view of wall of a building system with modular interlocking panels, which includes three wall sections, a first header, a second header, a wall sill, two door cripples and two window cripples in accordance with the present invention.
Figure 5A:
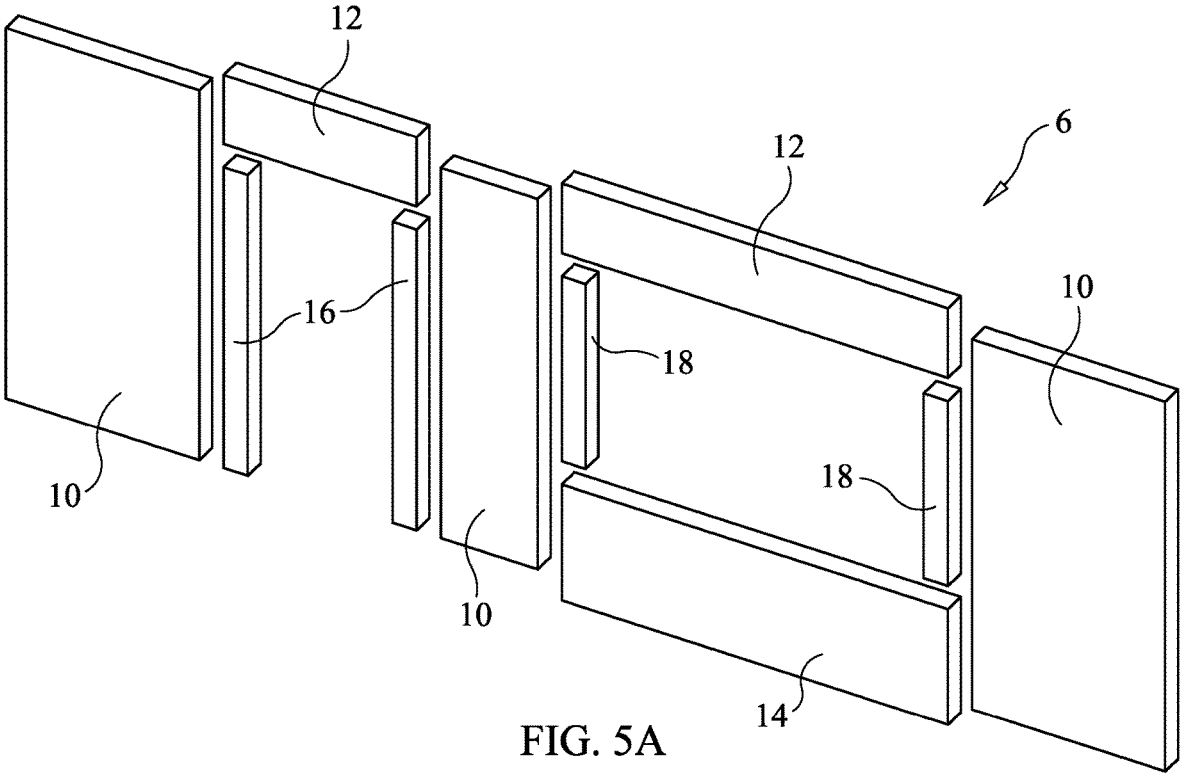
FIG. 5*a* is an exploded perspective view of wall of a building system with modular interlocking panels, which includes three wall sections, a first header, a second header, a wall sill, two door cripples and two window cripples in accordance with the present invention.

With reference to FIG. 5, a wall 6 includes at least one wall section 10 and may include at least one header 12, at least one wall sill 14, at least one door cripple 16 and at least one window cripple 18. With reference to FIG. 8, corners of adjacent walls 6, of the assembled building system with modular interlocking panels 1 are connected to each other using the end panel connectors 40. The wall sections 10 preferably come in 2 or 4 foot lengths and 8, 9 or 10 foot heights. However, other lengths and heights may also be used.

With reference to FIG. 6 each wall section 10, header 12 or wall sill 14 preferably includes the bottom horizontal C-channel 22, the plurality of bottom C-channel flanges 24, the plurality of vertical C-channels 26, the top horizontal C-channel 28, the plurality of top C-channel flanges 30, the outer panel 32, the inner panel 34, the first angled end panel connector 38 or the end panel connector 40 and the second angled end panel connector 38. The height of each header 12 or wall sill 14 is less than a height of the wall section 10. The length of the header or wall sill 14 may be any suitable length. Assembly of the header 12 and wall sill 14 components is the same as the wall section 10. The outer panel 32 and the inner panel 34 are preferably fabricated from a ballistic panel, but other materials may also be used.

Figure 4A:
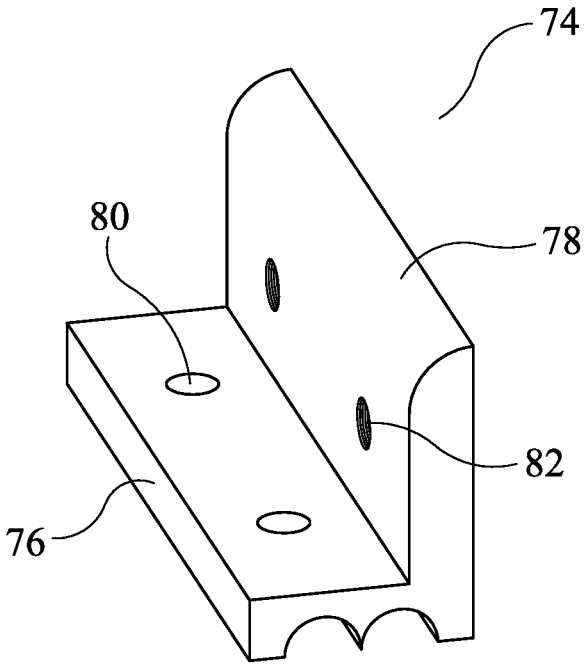
FIG. 4*a* is a perspective view of a bottom or top half C-channel flange for retaining a vertical C-channel in a horizontal C-channel in a cripple of a building system with modular interlocking panels in accordance with the present invention.
Figure 7:
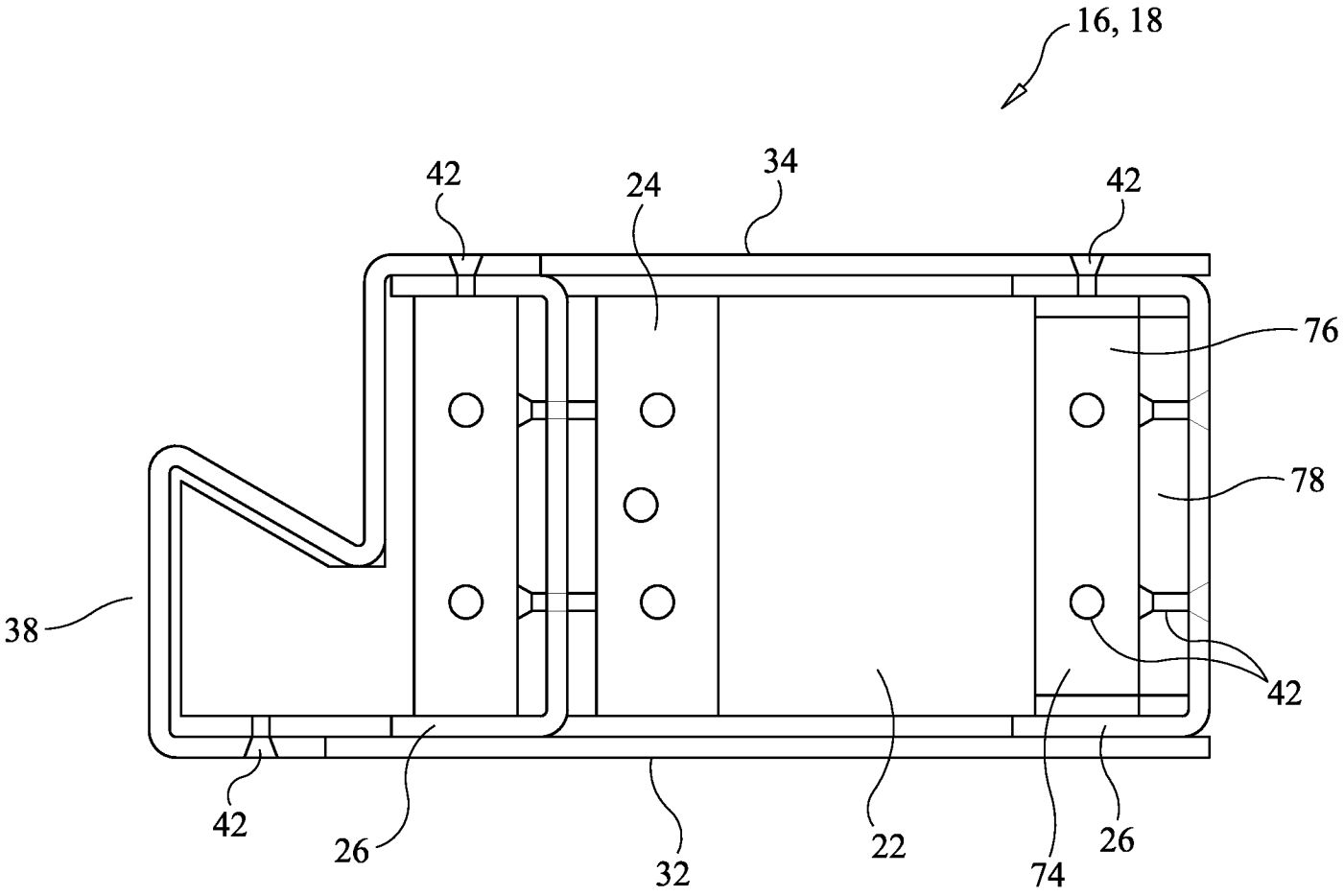
FIG. 7 is a top view of a door or window cripple with an upper horizontal C-channel removed of a building system with modular interlocking panels in accordance with the present invention.

With reference to FIG. 7, each door cripple 16 or window cripple 18 preferably includes the bottom horizontal C-channel 22, the at least one bottom C-channel flange 24, the at least one vertical C-channel 26, the top horizontal C-channel 28, the outer panel 32, the inner panel 34, the angled end panel connector 38 and a bottom or top half C-channel flange 74. With reference to FIG. 4*a*, the bottom or top C-channel flange 74 includes a bottom member 76 and an upright member 78, which extends upward from the bottom member 76. The bottom member includes a plurality of fastener holes 80. The upright member 78 includes a plurality of threaded taps 82 for receiving fasteners 42. The bottom member 76 of the bottom or top C-channel flange is attached to the bottom horizontal C-channel 22 with the fasteners 42. The upright member 78 is attached to the vertical C-channel 26 with the fasteners 42. The bottom member 76 is attached to the top horizontal C-channel 28 with the fasteners 42 (not shown). The angled end panel connectors 36, 38 and the end panel connector 40 may also be attached to the half C-channel flange 74. The height of each cripple 16, 18 is less than a height of the wall section 10. The cripple 16 18 may be any suitable length. Assembly of the cripple 16, 18 components is the same as the wall section 10.

Figure 3A:
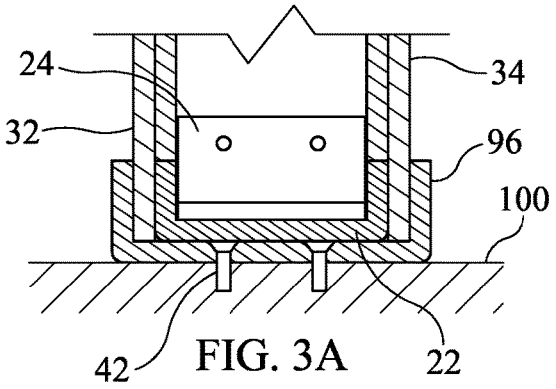
FIG. 3*a* is a cross section view of a wall section of a building system with modular interlocking panels cut through FIG. 1 and retained on a floor slab with a slab C-channel attached to the floor slab with fasteners and a bonding substance in accordance with the present invention.

With reference to FIG. 3, the plurality of support strips 20 preferably include a plurality of outer support strips 84 and a plurality of inner support strips 86. Each support strip 84, 86 includes a floor flange 88 and a channel flange 90, which extends upward from an end of the floor flange 88. A plurality of floor holes 92 are formed through the floor flange 88 to receive a plurality of fasteners 42 for anchoring the floor flange 88 to a floor slab 100. A plurality of channel holes 94 are formed through the channel flange 90 for anchoring to the bottom horizontal C-channel with the plurality of fasteners 42 or the bonding substance. With reference to FIG. 3*a*, the inner and outer support strips 84, 86 may be replaced with a single floor C-channel 96 includes an inner width which is sized to receive a thickness of the wall section 10, wall sill 14 and cripples 16, 18.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A building system includes at least one of a door cripple and a wall cripple, each one of said at least one door cripple and wall cripple, comprising:

a bottom horizontal member;

a plurality of vertical members;

a top horizontal member, a bottom of said plurality of vertical members is attached to said bottom horizontal member, a top of said plurality of vertical members is attached to said top horizontal member; and an end panel connector includes a first wall leg, a first end leg, an angled end leg, a second end leg and a second wall leg, said door cripple or said wall cripple is terminated with said end panel connector on one end, said first wall leg is attached to said top and bottom horizontal members, said first end leg extends outward from an end of said first wall leg, said angled end leg extends backward and inward at an acute angle from an end of the first end leg, said second end leg extends outward from an end of said angled end leg, said second wall leg extends backward from an end of said second end leg, said second wall leg is attached to said top and bottom horizontal members, said end panel connector results in said door cripple or said wall cripple having a different length on a first side than on a second side.

2. The building system of claim 1, wherein:

said member is a C-channel, a plurality of C-channel flanges, each one of said plurality of C-channel flanges includes an upright member and two opposing members which extend from opposing sides of said upright member, a web slot formed in said upright member to receive a web of one of said plurality of vertical C-channels.

3. The building system of claim 2, wherein:

said plurality of C-channel flanges are attached to said bottom horizontal C-channel and said top horizontal C-channel with a bonding substance, opposing ends of said plurality of vertical C-channels are retained by said plurality of C-channel flanges with a bonding substance.

4. The building system of claim 2, wherein:

said plurality of C-channel flanges are attached to said bottom horizontal C-channel and said top horizontal C-channel with a first plurality of fasteners, opposing ends of said plurality of vertical C-channels are retained by said plurality of C-channel flanges with a second plurality of fasteners.

5. A building system includes at least one of a wall section, a header and a wall sill, each one of said at least one wall section, header and wall sill, comprising:

a bottom horizontal member;

a plurality of vertical members;

a top horizontal member, a bottom of said plurality of vertical members is attached to said bottom horizontal member, a top of said plurality of vertical members is attached to said top horizontal member; and a first end panel connector and a second end panel connector each include a first wall leg, a first end leg, an angled end leg, a second end leg and a second wall leg, said wall section, said header or said wall sill is terminated on one end with said first end panel connector and on an opposing end with said second end panel connector, said first wall leg is attached to a first end of said top and bottom members, said first end leg extends outward from an end of said first wall leg, said angled end leg extends backward and inward at an acute angle from an end of the first end leg, said second end leg extends outward from an end of said angled end leg, said second wall leg extends backward from an end of said second end leg, said second wall leg is attached to said top and bottom horizontal members, said first end panel connector results in said wall section, said header or said wall sill having an offset length on a first side relative to a second side.

6. The building system of claim 5, wherein:

said member is a C-channel, a plurality of C-channel flanges, each one of said plurality of C-channel flanges includes an upright member and two opposing members which extend from opposing sides of said upright member, a web slot formed in said upright member to receive a web of one of said plurality of vertical C-channels.

7. The building system of claim 6, wherein:

said plurality of C-channel flanges are attached to said bottom horizontal C-channel and said top horizontal C-channel with a bonding substance, opposing ends of said plurality of vertical C-channels are retained by said plurality of C-channel flanges with a bonding substance.

8. The building system of claim 6, wherein:

said plurality of C-channel flanges are attached to said bottom horizontal C-channel and said top horizontal C-channel with a first plurality of fasteners, opposing ends of said plurality of vertical C-channels are retained by said plurality of C-channel flanges with a second plurality of fasteners.

9. A building system includes at least one of a wall section, a header and a wall sill, each one of said at least one wall section, header and wall sill, comprising:

a bottom horizontal member;

a plurality of vertical members;

a top horizontal member, a bottom of said plurality of vertical members is attached to said bottom horizontal member, a top of said plurality of vertical members is attached to said top horizontal member;

a first end panel connector includes a first wall leg, a first end leg, an angled end leg, a second end leg and a second wall leg, said wall section, said header or said wall sill is terminated on one end with said first end panel connector, said first wall leg is attached to a first end of said top and bottom members, said first end leg extends outward from an end of said first wall leg, said angled end leg extends backward and inward at an acute angle from an end of the first end leg, said second end leg extends outward from an end of said angled end leg, said second wall leg extends backward from an end of said second end leg, said second wall leg is attached to said top and bottom horizontal members, said first end connector resulting in said wall section, said header or said wall sill having an offset length on a first side relative to a second side; and a second end panel connector includes a first normal wall leg, a first normal end leg, a middle wall leg, a second normal end leg and a second normal wall leg, said first normal wall leg is attached to a second end of said top and bottom members, said first normal end leg extends outward from an end of said first normal wall leg, said middle wall leg extends backward from an end of said first normal end leg, said second normal end leg extends outward from an end of said middle wall, said second normal wall leg extends backward from an end of said second normal end leg, said second normal wall leg is attached to a second end of said top and bottom members, said first normal wall leg is attached to a second end of said top and bottom members.

10. The building system of claim 9, wherein:

said member is a C-channel, a plurality of C-channel flanges, each one of said plurality of C-channel flanges includes an upright member and two opposing members which extend from opposing sides of said upright member, a web slot formed in said upright member to receive a web of one of said plurality of vertical C-channels.

11. The building system of claim 10, wherein:

said plurality of C-channel flanges are attached to said bottom horizontal C-channel and said top horizontal C-channel with a bonding substance, opposing ends of said plurality of vertical C-channels are retained by said plurality of C-channel flanges with a bonding substance.

12. The building system of claim 10, wherein:

said plurality of C-channel flanges are attached to said bottom horizontal C-channel and said top horizontal C-channel with a first plurality of fasteners, opposing ends of said plurality of vertical C-channels are retained by said plurality of C-channel flanges with a second plurality of fasteners.

13. The building system of claim 9, further comprising:

a plurality of support strips include a plurality of outer support strips and a plurality of inner support strips, each said support strip includes a floor flange and a channel flange, said channel flange extends upward from an end of said floor flange, wherein said plurality of floor flanges are attached to a floor slab of a building, said channel flanges are attached to a plurality of bottom C-channels.

14. The building system of claim 9, further comprising:

a floor C-channel includes an inner width which is sized to receive a thickness of said at least one wall section, window sill or a cripple, wherein said floor C-channel is attached to a floor slab, said at least one wall section, window sill or cripple is retained in said inner width;

an outer panel attached to an outside of said C-channels; and an inner panel attached to an inside of said C-channels.

15. A building system includes a wall section, comprising:

a bottom horizontal member;

a plurality of vertical members;

a top horizontal member, a bottom of said plurality of vertical members is attached to said bottom horizontal member, a top of said plurality of vertical members is attached to said top horizontal member;

a first end panel connector and a second end panel connector each include a first wall leg, a first end leg, a middle wall leg, a second end leg and a second wall leg, said first wall leg of said first end panel connector is attached to a first end of said top and bottom horizontal members, said first end leg extends outward from an end of said first wall leg, said middle wall leg extends backward from an end of said first end leg, said second end leg extends outward from an end of said middle wall, said second wall leg extends backward from an end of said second end leg, an end of said first wall leg is offset from an end of said second wall leg, said second wall leg is attached to a second end of said top and bottom horizontal members, said first wall leg of said first end panel connector is attached to said first end of said top and bottom members; and said first wall leg and said second wall leg of said second end connector are attached to a second end of said top and bottom horizontal members, wherein said wall section is longer on an outside surface than on an inside surface.

16. The building system of claim 15, wherein:

said first wall leg, said middle wall leg and said second wall leg are parallel to each other.

17. The building system of claim 15, wherein:

said member is a C-channel, a plurality of C-channel flanges, each one of said plurality of C-channel flanges includes an upright member and two opposing members which extend from opposing sides of said upright member, a web slot formed in said upright member to receive a web of one of said plurality of vertical C-channels.

18. The building system of claim 17, wherein:

said plurality of C-channel flanges are attached to said bottom horizontal C-channel and said top horizontal C-channel with a bonding substance, opposing ends of said plurality of vertical C-channels are retained by said plurality of C-channel flanges with a bonding substance.

19. The building system of claim 18, wherein:

at least one bonding groove is formed in a bottom of said plurality of C-channel flanges to receive said bonding substance.

20. The building system of claim 17, wherein:

said plurality of C-channel flanges are attached to said bottom horizontal C-channel and said top horizontal C-channel with a first plurality of fasteners, opposing ends of said plurality of vertical C-channels are retained by said plurality of C-channel flanges with a second plurality of fasteners.

* * * * *